United States Patent [19]

Williams et al.

[11] 4,417,527

[45] Nov. 29, 1983

[54] AUTOMATIC TELLER SECURITY APPARATUS

[76] Inventors: Waymon D. Williams, 7206 La Manga, Dallas, Tex. 75248; Edward A. Moore, 3305 Heathercrest Dr., Garland, Tex. 75042

[21] Appl. No.: 293,501

[22] Filed: Aug. 17, 1981

[51] Int. Cl.[3] ..... E04H 1/12; E04B 1/346; A47B 43/00

[52] U.S. Cl. ..... 109/2; 109/53; 109/9; 312/258; 312/324; 52/64; 52/79.8

[58] Field of Search ..... 109/65–69, 109/53, 1 R, 2, 9, 22–24, 24.1, 49.5, 64; 40/605; 312/258, 324; 52/64, 79.8

[56] References Cited

U.S. PATENT DOCUMENTS 385,622 0/1908 Bessin ..... 52/64

4,085,687 4/1978 Beck ..... 109/24.1

*Primary Examiner*—Robert Peshock

*Assistant Examiner*—John Weiss

*Attorney, Agent, or Firm*—Kanz & Timmons

[57] ABSTRACT

A security apparatus for use in servicing an automatic teller machine located on an automobile service island of the sort commonly used in connection with drive through banking. The apparatus provides a protected enclosure rotatable between first and second positions with respect to the automatic teller machine housing enclosure. In the first position, the enclosure is stored out of the vehicular right of way. In the second position, the enclosure abuts the rear of the automatic teller machine housing enclosure and interconnects with such housing enclosure.

12 Claims, 5 Drawing Figures

AUTOMATIC TELLER SECURITY APPARATUS

DESCRIPTION

Technical Field

Automatic teller machines have become common at banking institutions across the country. These machines were designed to assist bank customers in obtaining and depositing cash by automatically adjusting the customer's account balance in response to signals input by the customer at the consol of the signals input by the customer at the consol of the automatic teller machine.

The accuracy of the machine depends upon the integrity of its account access codes and circuitry used to implement such access control features. These machines are not continuously monitored by a bank employee. This fact makes the machine particularly vulnerable to tampering. The potential for fraud and theft is manifest.

The installation of an automatic teller machine on a drive through bank service island presents a particular security problem. In such a location, the machine is vulnerable to compromise twenty-four hours a day, seven days a week. The provision of a strong enclosure for the machine is particularly important.

The exposed location of the machine makes routine service risky and inconvenient. Service of out door machines has required that the bank's agent open the back of the automatic teller machine in plain view of unauthorized persons. In the course of day to day routine service, the bank's agent is exposed to the repeated risk of sudden attack by criminals during the service operation. Such an attack could have as its objective the theft of cash from the cash box of the machine. The attack could also be used to gain access to the bank's computer accounting network.

Before automatic teller machines can be widely used for drive-in banking, it will be necessary to address the need for strong enclosures and protected service access.

The provision of a hardened, heavy metal portal for securing against unauthorized access to the machine has been thought to be inconsistent with routine authorized access. The reason is that routine opening means would constitute the weak link in the protective system. There is thus a need for cooperation between sheltered service access means and portal locking means.

Accordingly, it is an object of the current invention to provide a hardened, heavy metal portal protecting against unauthorized access.

It is also an object of the current invention to provide a protecting enclosure that cooperates with such portal during routine service of the machines.

Another object of the invention is to provide a means of securing access to the machine while, at the same time, retaining the narrow structural configuration appropriate for installation on a drive through automobile service island.

Other objects of the current invention will appear from the disclosure below.

DISCLOSURE OF INVENTION

To implement these and other objects, the current invention provides a system of enclosures and interlocking passageways. A first enclosure, a machine housing enclosure is fixed to the service island. An automatic teller machine is mounted on one side of the housing enclosure with its consol exposed to passing automobiles.

A second enclosure, a pivoting protective enclosure, is rotatable between first and second positions. In the first position, the protective enclosure is stored on the service island in substantial alignment with the housing enclosure. In the second position, the protective enclosure is reoriented so that it abuts against the housing enclosure behind the automatic teller machine.

The protective enclosure can be brought into position behind the automatic teller machine by a variety of maneuvers. It could be mounted on sliding tracks; or it could be suspended from a crane. The preferred method for maneuver is to pivot the protective enclosure about an axis defined by one of its corner edges. The pivot is facilitated by means of a 5,000 pound test hinge running the length of such corner edge and connecting such edge to a corresponding edge of the housing enclosure. Such a hinge would allow smooth rotation between the first and second positions previously described.

The housing enclosure includes a reinforced portal positioned in access providing relationship to the automatic teller machine mounted on said enclosure. The protective enclosure includes a portal dimensioned to correspond to the portal of the housing enclosure. The portal of the protective enclosure fits over and interlocks with the portal of the housing enclosure to provide intercommunication between the two enclosures when the protective enclosure is positioned in its second position.

Because of the interlock feature, access to the machine housing enclosure is possible only through the protective enclosure when the protective enclosure is in its second position.

In addition to the portal, the protective enclosure includes a door through which service personnel may enter the second enclosure. Once inside the second, or protective enclosure, the authorized personnel can close and lock this door, before interlocking the portals and gaining access to the first, or housing, enclosure containing the automatic teller machine.

When servicing is completed, the service man closes the portals, disengages the interlock, steps out of the second enclosure locking its door behind him, and pivots the second enclosure back to its storage position on the service island aligned with the first enclosure.

BEST MODE FOR CARRYING OUT THE INVENTION

Figure 1:
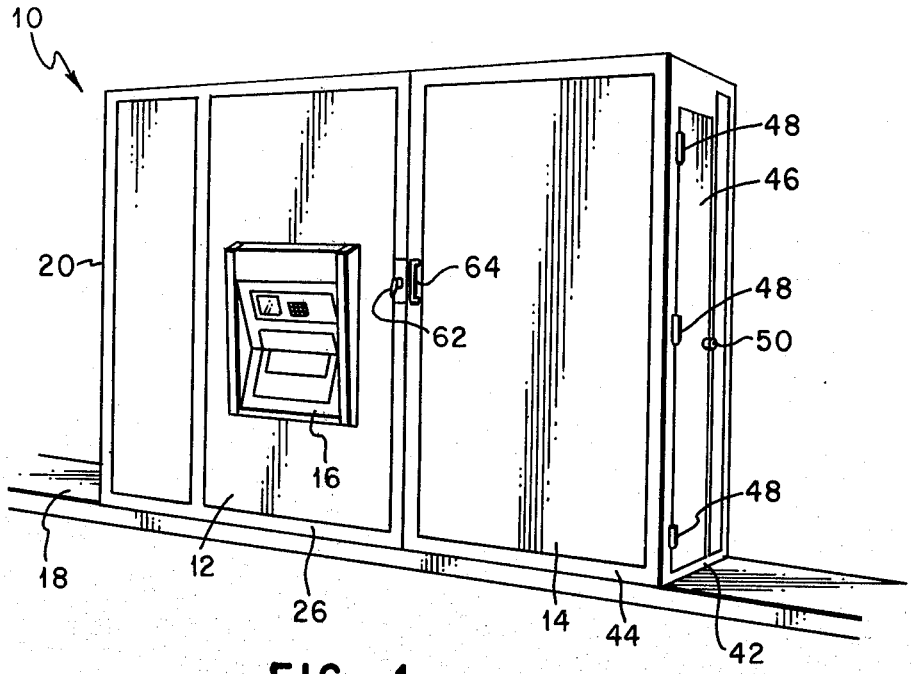
FIG. 1 is a perspective view showing the Drive Through Protective Apparatus in its normal, public service configuration.

With reference now to FIG. 1, the preferred embodiment of the Drive Through Protective Apparatus is designated generally by the number 10. The apparatus is divided into first enclosure 12 and second enclosure 14.

Mounted on the first enclosure is the consol of an automatic teller machine 16.

First enclosure 12 is fixedly mounted to service island 18. Service island 18 is a raised platform composed of a concrete curb and surface of the type normally found at drive through banks and similar to those found in gasoline stations.

First enclosure 12 comprises a solid figure having first 20, second 22, third 24 and fourth 26 sides numbered clockwise consecutively from first side 20.

Figure 2:
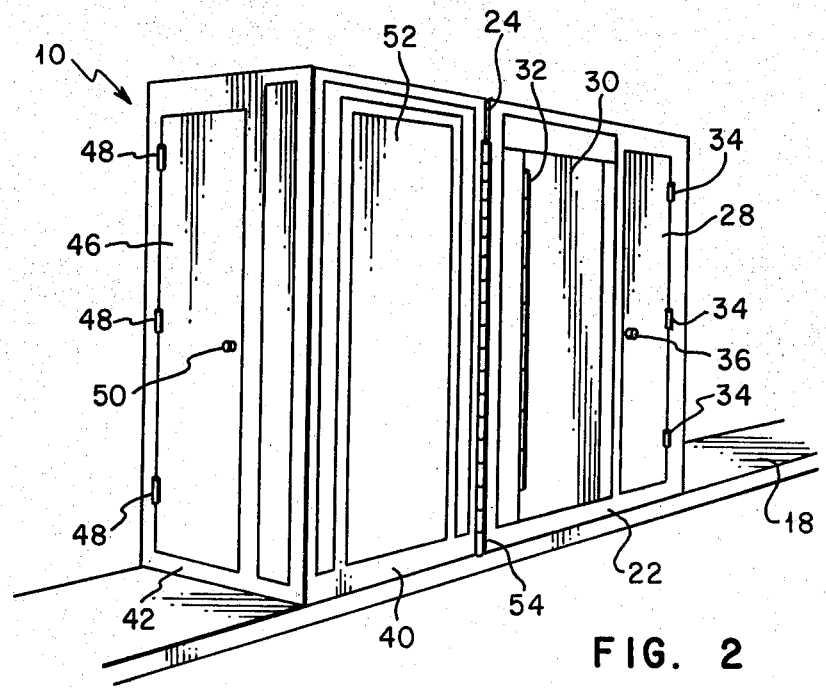
FIG. 2 is a perspective view of the reverse side of the apparatus of FIG. 1.

With reference to FIG. 2, on the second side 22 of the first enclosure 12 are mounted a door 28 and a reinforced portal 30. The reinforced portal 30 presents a flat surface having no projections and hinged at one edge with 5,000 pound shear test hinge 32. Door 28 is equiped with three standard door hinge members 34 and bolt keylock 36.

Second enclosure 14 also comprises a solid figure having first 38, second 40, third 42, and fourth 44 sides numbered clockwise consecutively from said first side 38.

On said third side 42 of second enclosure 14 is a standard door 46 hung on three standard hinge members 48 and having bolt keylock 50.

On the second side 40 of the second enclosure 14 is hung interlocking portal 52. Portal 52 swings inward with respect to second enclosure 14.

Figure 3:
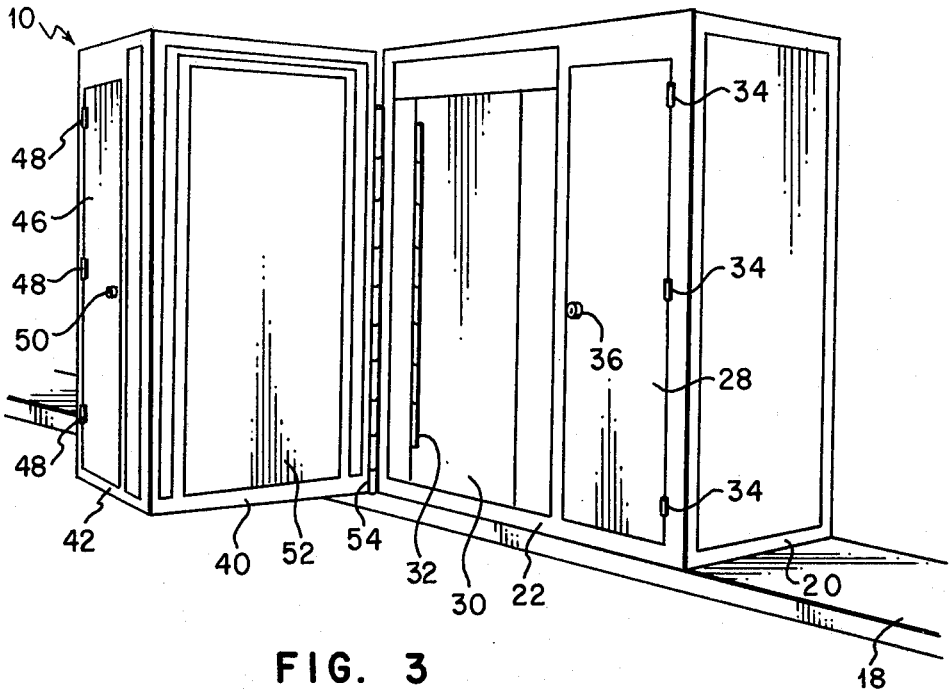
FIG. 3 is a perspective view showing the Drive Through Protective Apparatus in the midst of its pivot between first and second positions.

Referring now to FIG. 3, second enclosure 14 is shown being pivoted about 5,000 pounds shear test hinge 54 connecting the edge defined by second 22 and third 24 sides of first enclosure 12 with the edge defined by first 38 and second 40 sides of second enclosure 14.

Figure 4:
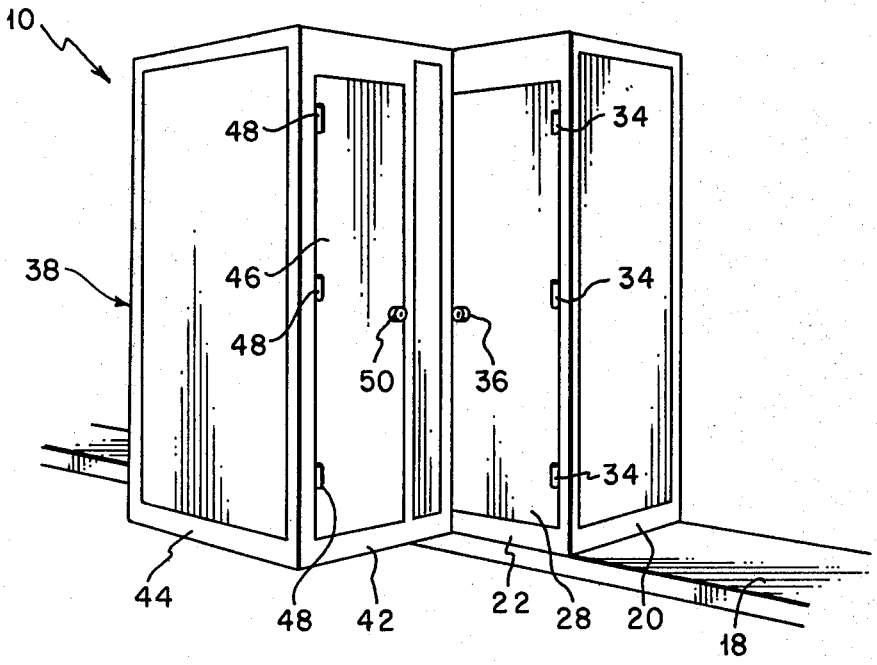
FIG. 4 is a perspective view showing the Drive Through Protective Apparatus after completion of the pivot.

Referring now to FIG. 4, second enclousre 14 is shown in its second position relative to first enclosure 12. First enclosure 12 and second enclosure 14 now form an "L" shaped configuration. In this configuration, portal 30 and portal 52 are in substantial abutment and can be opened serially beginning with portal 52.

Figure 5:
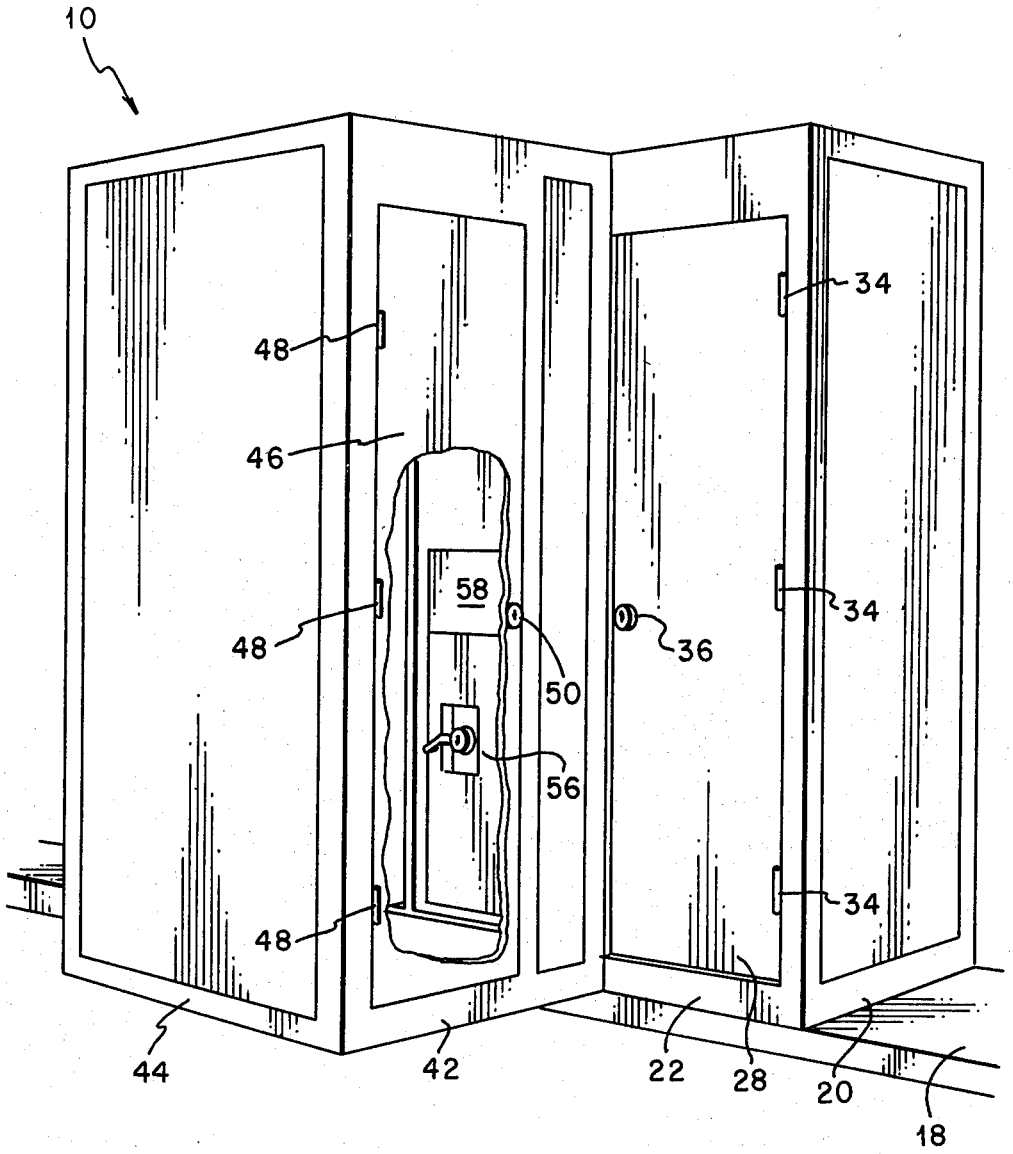
FIG. 5 is a perspective view partially cut away showing the interior of the Drive Through Protective Apparatus after intercommunication has been established.

Referring now to FIG. 5, the interior of second enclosure 14 is shown, partially cut away. Portals 30 and 52 are shown open to reveal safe door 56. Safe door 56 is open to reveal internal components and cash box 58 of automobile teller machine 16.

By reference to FIG. 5, it can be seen that a secure working enclosure is provided for authorized service of the automatic teller machine 16. Inside second enclosure 14, a service man may lock bolt lock 50 to protect himself from intruders during the service operation. He may then open portals 39 and 52 to find safe door 56. With safe door 56 open, he is free to service internal components 58 or replace cash in the cash box.

When the service man has completed his duties, he closes safe door 51, followed by portals 30 and 52. He may then leave the second enclosure 14, locking door 46 after exit. Second enclosure 14 is then pivoted back into its first position as shown in FIG. 1. It is latched in this position by conventional means such as a "french door" latch or other similar latch 62. Handle 64 is provided to assist the pivot operation.

While a particular embodiment of the current invention has been illustrated and described, it will be apparent that other embodiments could be described that fall within the spirit and scope of this invention.

We claim:

1. For use in association with an automatic teller machine having a cash box and internal mechanical and electrical parts and having an exposed control panel, a security apparatus comprising:

(a) a first enclosure;
(b) a second enclosure;
(c) a stationary platform;
(d) securing means for securing said first enclosure to said stationary platform;
(e) pivot means connecting said first and second enclosures so that said second enclosure is rotatable about a substantially vertical axis between a first position and a second position which is distinct from the first position wherein the second enclosure is in substantial abutment with the first enclosure when in the second position;
(f) mounting means on said first enclosure for mounting said automatic teller machine so that said control panel of said automatic teller machine is exposed and said cash box and internal parts of said automatic teller machine are concealed within said first enclosure;
(g) service entry means for gaining entry to said second enclosure when said second enclosure is in said second position;
(h) portal means for providing access into the first enclosure by a user located in the second enclosure only when said second enclosure is in said second position.

2. The apparatus as claimed in claim 1 wherein said portal means comprises:

(a) a first portal on said first enclosure in spaced relationship to said automatic teller machine; and
(b) a second portal disposed on said second enclosure so that said second portal may be brought into substantial abutment with said first portal when said second enclosure is in said second position.

3. The apparatus as claimed in claim 2 wherein said service entry means comprises a door on said second enclosure disposed so that said door is in a plane perpendicular to the plane of said first portal of said first enclosure when said second enclosure is in said second position.

4. The apparatus as claimed in claim 3 wherein said service entry means further comprises;

(a) hinge pivot means connecting said door to said second enclosure;
(b) a door jamb means on said second enclosure to prevent said door from pivoting into the interior of said second enclosure; and
(c) a bolt lock releasably connecting said door

5. The apparatus as claimed in claim 4 wherein the said first enclosure is a box having first, second, third and fourth rectangular sides and top and bottom rectangular ends.

6. The apparatus as claimed in claim 5 wherein the said second enclosure is a box having first, second, third and fourth rectangular sides and top and bottom rectangular ends.

7. The apparartus as claimed in claim 6 wherein said pivot means comprises a hinge member connected between an edge corner defined by the second and third sides of said first enclosure and an edge corner defined by said first and second rectangular sides of said second enclosure.

8. The apparatus as claimed in claim 7 wherein said first portal on said first enclosure is located on said second rectangular side of said first enclosure and said second portal on said second enclosure is located on said second rectangular side of said second enclosure.

9. The apparatus as claimed in claim 8 wherein said door is located on said third rectangular side of said second enclosure.

10. The apparatus as claimed in claim 9 wherein said control panel of said automatic teller machine is exposed from the fourth rectangular side of said first enclosure.

11. The apparatus as claimed in claim 10 wherein said securing means attaches said bottom end of said first enclosure to said stationary platform.

12. A method for providing secure access to the internal parts and cash box of an automatic teller machine having an exposed control panel comprising the steps of:

(a) mounting said automatic teller machine so that the control panel is exposed;

(b) enclosing said internal parts and cash box within a first enclosure;

(c) pivoting a second enclosure attached to said first enclosure between a first position and a second position which is distinct from the first position wherein the second enclosure is in substantial abutment with the first enclosure when in the second position;

(d) providing entry into said second enclosure from outside of the automatic teller machine;

(e) providing access into the first enclosure from the second enclosure when said second enclosure is in said second position.

* * * * *

UNITED STATES PATENT AND TRADEMARK OFFICE

CERTIFICATE OF CORRECTION

PATENT NO. : 4,417,527

DATED : November 29, 1983

INVENTOR(S) : Waymond D. Williams and Edward A. Moore

It is certified that error appears in the above-identified patent and that said Letters Patent are hereby corrected as shown below:

Column 4, line 8 of claim 4 after the word "door" insert --to said jamb.--

Signed and Sealed this

*Third* Day of *April 1984*

[SEAL]

*Attest:*

GERALD J. MOSSINGHOFF

*Attesting Officer*

*Commissioner of Patents and Trademarks*